US009158239B2

(12) United States Patent
Adachi

(10) Patent No.: US 9,158,239 B2
(45) Date of Patent: Oct. 13, 2015

(54) CLEANING BIAS CONTROL FOR AN IMAGE FORMING APPARATUS

(71) Applicant: Aya Adachi, Nagoya (JP)

(72) Inventor: Aya Adachi, Nagoya (JP)

(73) Assignee: Brother Kogyo Kabushiki Kaisha, Nagoya-shi, Aichi-ken (JP)

( * ) Notice: Subject to any disclaimer, the term of this patent is extended or adjusted under 35 U.S.C. 154(b) by 67 days.

(21) Appl. No.: 14/027,279

(22) Filed: Sep. 16, 2013

(65) Prior Publication Data

US 2014/0086603 A1 Mar. 27, 2014

(30) Foreign Application Priority Data

Sep. 26, 2012 (JP) ..... 2012-212218

(51) Int. Cl.
*G03G 15/00* (2006.01)
*G03G 15/16* (2006.01)

(52) U.S. Cl.
CPC ..... *G03G 15/161* (2013.01)

(58) Field of Classification Search
CPC ..... G03G 15/161; G03G 21/00
USPC ..... 399/44, 71, 98, 99, 101, 314, 343
See application file for complete search history.

(56) References Cited

U.S. PATENT DOCUMENTS 6,029,022 A * 2/2000 Takase ..... 399/66
6,341,205 B1 * 1/2002 Yoshino et al. ..... 399/101
7,697,855 B2 4/2010 Fukami et al.
8,351,818 B2 1/2013 Hayakawa et al.
2008/0056743 A1 3/2008 Fukami et al.
2009/0297176 A1 * 12/2009 Haruyama ..... 399/27
2010/0124430 A1 * 5/2010 Furukawa ..... 399/71
2010/0129108 A1 * 5/2010 Hayakawa et al. ..... 399/98
2011/0255889 A1 * 10/2011 Ogiso et al. ..... 399/44
2011/0286752 A1 * 11/2011 Burry et al. ..... 399/21
2014/0119759 A1 * 5/2014 Yamaura et al. ..... 399/66

FOREIGN PATENT DOCUMENTS

JP 11-084916 A 3/1999
JP 2008-058566 A 3/2008
JP 2010-128052 A 6/2010

* cited by examiner

*Primary Examiner* — Francis Gray
(74) *Attorney, Agent, or Firm* — Banner & Witcoff, Ltd.

(57) ABSTRACT

An image forming apparatus includes: an endless belt having an outer circumferential surface for conveying a recording sheet; a photosensitive member provided to face the outer circumferential surface of the endless belt; a cleaning member provided to face the outer circumferential surface of the endless belt and configured to clean the outer circumferential surface of the endless belt; and a control device configured to control a cleaning bias to be applied to the cleaning member such that while a portion of the outer circumferential surface of the endless belt, which has contacted the recording sheet since being cleaned by the cleaning member, faces the cleaning member, a second bias, which is larger than a first bias having been applied to the cleaning member before the corresponding portion faces the cleaning member, is applied to the cleaning member.

20 Claims, 6 Drawing Sheets

CLEANING BIAS CONTROL FOR AN IMAGE FORMING APPARATUS

CROSS-REFERENCE TO RELATED APPLICATIONS

This application claims priority from Japanese Patent Application No. 2012-212218 filed on Sep. 26, 2012, the entire subject matter of which is incorporated herein by reference.

TECHNICAL FIELD

Illustrative aspects of the present invention relate to an image forming apparatus having a cleaning member configured to clean an outer circumferential surface of an endless belt for conveying a recording sheet.

BACKGROUND

In an image forming apparatus configured to form an image electrophotographically, a transfer member is provided on an inner side of an endless belt for conveying a sheet such that the transfer member faces a photosensitive member with the endless belt being interposed therebetween. By applying transfer bias to the transfer member, developer (toner) carried on the photosensitive member is transferred onto a recording sheet conveyed by the endless belt.

In this image forming apparatus, in order to remove developer, paper dust, and so forth attached to the endless belt during an image forming (printing) operation, a cleaning member is provided to face an outer circumferential surface of the endless belt. In general, after printing completes, a cleaning bias is applied to the cleaning member, whereby the developer and so forth on the endless belt is transferred onto the cleaning member so as to be collected. Further, there is also known an image forming apparatus which applies a constant cleaning bias (voltage) to a cleaning member even during printing in order to remove the developer and so forth from the endless belt,

SUMMARY

It has been required to provide an image forming apparatus capable of exhibiting good cleaning performance while suppressing a cleaning member or an endless belt from being deteriorated due to application of a cleaning bias.

Therefore, according to one illustrative aspect of the present invention, there is provided an image forming apparatus comprising: an endless belt having an outer circumferential surface for conveying a recording sheet; a photosensitive member that is provided to face the outer circumferential surface of the endless belt; a cleaning member that is provided to face the outer circumferential surface of the endless belt and is configured to clean the outer circumferential surface of the endless belt; and a control device configured to control a cleaning bias to be applied to the cleaning member. The control device is configured to control the cleaning bias so as to: apply a first bias to the cleaning member before a portion of the outer circumferential surface of the endless belt, which has contacted the recording sheet since being cleaned by the cleaning member, faces the cleaning member; and apply a second bias, which is larger than the first bias, to the cleaning member while the portion of the outer circumferential surface of the endless belt, which has contacted the recording sheet since being cleaned by the cleaning member, faces the cleaning member.

DETAILED DESCRIPTION

<General Overview>

Figure 1:
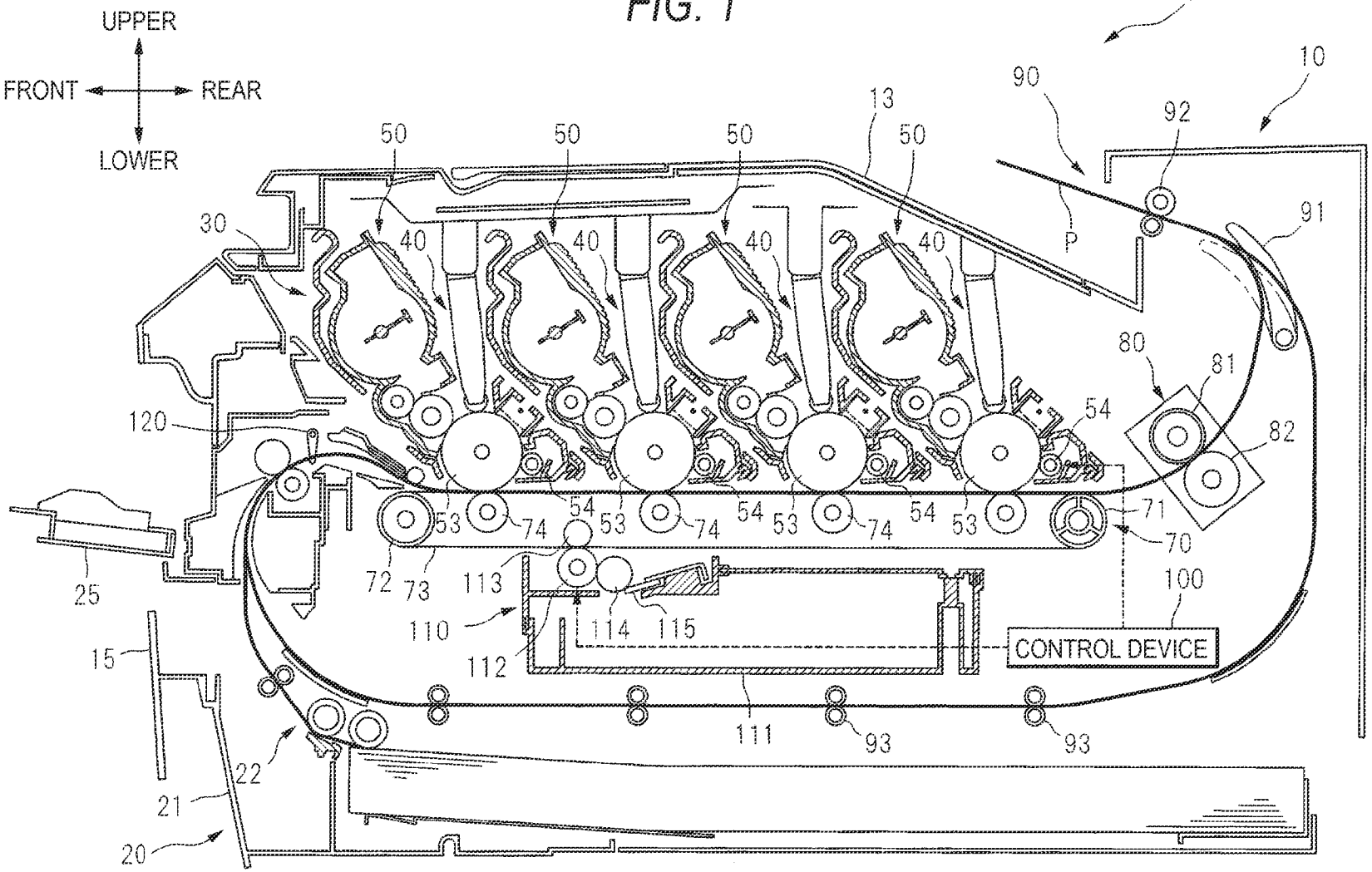
FIG. 1 is a cross-sectional view illustrating the overall configuration of a printer which is an example of an image forming apparatus.

A cleaning bias optimized for collecting developer may not be necessarily sufficient for collecting paper dust, in such a case, uncollected paper dust may adhere to or be deposited on the photosensitive members, together with developer components (so-called filming), causing unevenness in the shape or resistance value of the surface of each photosensitive member. As a result, a quality of a developer image to be formed may be deteriorated.

On the other hand, if a high cleaning bias, which enables to collect the paper dust in addition to the developer, is continuously applied, deterioration of the cleaning member or the endless belt may be advanced, so that this is not preferable.

Therefore, it has been required to provide an image forming apparatus capable of exhibiting good cleaning performance while suppressing a cleaning member or an endless belt from being deteriorated due to application of a cleaning bias.

According to a first illustrative aspect of the present invention, there is provided an image forming apparatus comprising: an endless belt having an outer circumferential surface for conveying a recording sheet; a photosensitive member that is provided to face the outer circumferential surface of the endless belt; a cleaning member that is provided to face the outer circumferential surface of the endless belt and is configured to clean the outer circumferential surface of the endless belt; and a control device configured to control a cleaning bias to be applied to the cleaning member. The control device is configured to control the cleaning bias so as to: apply a first bias to the cleaning member before a portion of the outer circumferential surface of the endless belt, which has contacted the recording sheet since being cleaned by the cleaning member, faces the cleaning member; and apply a second bias, which is larger than the first bias, to the cleaning member while the portion of the outer circumferential surface of the endless belt, which has been contacted the recording sheet since being cleaned by the cleaning member, faces the cleaning member.

According to the image forming apparatus configured as described above, the second bias that is larger than the first bias is applied while the portion of the outer circumferential surface of the endless belt, which has contacted the recording sheet since being cleaned by the cleaning member, faces the cleaning member. Therefore, it is possible to intensively cleaning a portion of the endless belt where the recording sheet is placed and a possibility that paper dust having been in contact with the endless belt is attached thereto is high, by applying the second bias set to have a magnitude appropriate for collecting paper dust.

Further, it is possible to prevent the second bias, which is larger than the first bias, from being applied while a portion of the endless belt where the recording sheet is not placed (where a possibility that paper dust is attached thereto is low) faces the cleaning member. Therefore, it is possible to suppress the cleaning member or the endless belt from being deteriorated by continuing to apply a high cleaning bias, so that it is possible to expand the service life of the cleaning member or the endless belt.

According to the second illustrative aspect of the present invention, the image forming apparatus further comprises: a sensor configured to detect a leading end of the conveyed recording sheet, wherein when a first predetermined time elapses from a timing of detection of the leading end of the recording sheet by the sensor, the control device changes the cleaning bias from the first bias to the second bias.

According thereto, it is possible to accurately determine a position where the leading end portion of a recording sheet is placed by using the detection result of the sensor.

According to a third illustrative aspect of the present invention, when a second predetermined time, which is longer than the first predetermined time, elapses from the timing of the detection of the leading end of the recording sheet by the sensor, the control device changes the cleaning bias from the second bias to the first bias.

According thereto, it is possible to accurately determine a position where the trailing end portion of a recording sheet is placed by using the detection result of the sensor.

According to a fourth illustrative aspect of the present invention, when a third predetermined time elapses from a timing of detection of a rear end of the recording sheet by the sensor, the control device changes the cleaning bias from the second bias to the first bias.

A position where the trailing end portion of a recording sheet is placed is also determined by using the detection result of the sensor. According thereto, it is possible to more accurately determine a range where each recording sheet is placed.

According to a fifth illustrative aspect of the present invention, the control device is configured to control the cleaning bias so as to apply the second bias to the cleaning member even while a portion of the outer circumferential surface of the endless belt, which is from a position where the rear end of the recording sheet is placed to a position posterior to the position where the rear end of the recording sheet is placed by a length of the outer circumference of the photosensitive member, faces the cleaning member.

According to this configuration, it is possible to effectively discharge a portion of the endless belt where electric charge injected by applying the transfer bias is remaining, or uniformize the charged state (electric charge distribution) of the corresponding portion, by the second bias that is larger than the first bias. Therefore, it is possible to improve the quality of an image to be formed on the subsequent recording sheet.

According to a sixth illustrative aspect of the present invention, the second predetermined time is determined according to a length of the recording sheet in a conveyance direction.

According to this configuration, it is possible to intensively clean the portion of the endless belt where the recording sheet is placed and a possibility that paper dust having been in contact with the endless belt is attached thereto is high, by applying the second bias set to have a magnitude appropriate for collecting paper dust.

According to a sixth illustrative aspect of the present invention, the second predetermined time is determined according to a sum of a length of the recording sheet in a conveyance direction and a length of the outer circumference of the photosensitive member.

According to this configuration, it is possible to effectively discharge a portion of the endless belt where electric charge injected by applying the transfer biases is remaining, or uniformize the charged state (electric charge distribution) of the corresponding portion, by the second bias that is larger than the first bias. Therefore, it is possible to improve the quality of an image to be formed on the subsequent recording sheet.

According to an eighth illustrative aspect of the present invention, the image forming apparatus further comprises: a humidity determining unit configured to determine an internal humidity of a main apparatus body of the image forming apparatus, wherein when the humidity determining unit determines that the internal humidity exceeds predetermined humidity, the control device changes the cleaning bias from the first bias to the second bias.

According to a ninth illustrative aspect of the present invention, the image forming apparatus further comprises: a manual feed tray that is swingably supported by a main apparatus body of the image forming apparatus and is configured to feed the recording sheet, wherein when a conveyed recording sheet is fed from the manual feed tray, the control device changes the cleaning bias from the first bias to the second bias.

According thereto, information based on determination of the humidity determining unit, or information on a tray feeding recording sheets is used to perform control such that the cleaning bias is changed to the second bias under a condition in which paper dust is likely to be deposited and thus deterioration of image quality due to filming is especially likely to occur. Therefore, it is possible to suppress deterioration of the cleaning member or the endless belt.

According to a tenth illustrative aspect of the present invention, the first bias is zero.

It is possible to more effectively suppress deterioration of the cleaning member or the endless belt by setting the bias to be applied to the cleaning member to zero except when the second bias is applied.

According to an eleventh illustrative aspect of the present invention, when continuous printing is performed to continuously print a plurality of recording sheets, the control device is configured to control the cleaning bias so as to continuously apply the second bias to the cleaning member from when a portion of the outer circumferential surface of the endless belt where the leading end of a first recording sheet is positioned reaches the cleaning member to when a portion of the outer circumferential surface of the endless belt where the rear end of a last recording sheet is positioned reaches the cleaning member.

According to another illustrative aspect of the present invention, there is provided an image forming apparatus comprising: an endless belt configured to convey a recording sheet; an image forming unit configured to form an image on the recording sheet conveyed by the endless belt; a cleaning member configured to clean the endless belt; a sensor configured to detect the recording sheet; a control device configured to control a cleaning bias to be applied to the cleaning member. The control device is configured to control the cleaning bias so as to: apply a first bias as the cleaning bias to the cleaning member; and change the cleaning bias from the first bias to a second bias, which is larger than the first bias, when a first predetermined time elapses after the sensor detects a leading end of the recording sheet.

According to this configuration, when continuous printing is carried out, it is possible to apply the second bias without interruptions at portions of the outer circumferential surface of the endless belt where the end portions of each recording sheet especially likely to generate paper dust are placed. Therefore, it is possible to more effectively remove paper dust.

According to the illustrative aspects of the present invention, since it becomes possible to remove paper dust during a printing operation, it is possible to suppress deterioration in image quality due to filming of the photosensitive members by paper dust. Further, since it is possible to intensively clean a portion of the endless belt where a recording sheet is placed and a possibility that paper dust having been in contact with the endless belt is attached thereto is high, by applying the second bias appropriate for collecting paper dust, it is possible to improve a paper dust removal efficiency while restricting a time to apply the large second bias causing deterioration of the cleaning member or the endless belt.

<Exemplary Embodiments>

Hereinafter, exemplary embodiments of the present invention will be described in detail with reference to appropriate drawings. In the following description, first, the overall configuration of a color printer will be described, and then the features of the present invention will be described in detail.

In the following description, unless otherwise stated, directions of a color printer refer to the directions as seen from a user facing to the color printer during its use. To be more specific, referring to FIG. 1, a left-side direction and a right-side direction of the drawing sheet are referred to as a "front side" and a "rear side" of the color printer, respectively. Further, a direction away from a viewer of FIG. 1 is referred to as a "left side", and a direction toward the viewer of FIG. 1 as a "right side". An upward and downward direction in FIG. 1 is referred to as a "vertical direction" or an "upward and downward direction" as it is.

As shown in FIG. 1, a color printer 1 includes a sheet feeding unit 20 configured to feed a sheet P, which is an example of a recording sheet, an image forming unit 30 configured to form an image on the fed sheet P, a sheet discharging unit 90 configured to discharge the sheet P having the image formed thereon, and a control device 100, inside a main apparatus body 10.

The sheet feeding unit 20 is provided at a lower portion of the inside of the main apparatus body 10. The sheet feeding unit 20 includes a sheet feeding tray 21 that is removably installed in the main apparatus body 10, and a sheet feeding mechanism 22 configured to convey a sheet P from the sheet feeding tray 21 to the image forming unit 30. In the sheet feeding unit 20, the sheets P stored in the sheet feeding tray 21 are separated one at a time by the sheet feeding mechanism 22, and are fed to the image forming unit 30.

A part of a front cover 15 for covering the front of the main apparatus body is configured as a manual feed tray 25. The manual feed tray 25 is configured to be swingable (openable). In order to perform printing, when a user puts a sheet P on the manual feed tray 25, which is opened as shown in FIG. 1, and designates (selects) the manual feed tray in printing options, the sheet P is fed from the manual feed tray 25 to the image forming unit 30 by the sheet feeding mechanism 22.

The image forming unit 30 includes four LED units 40, four process cartridges 50, a transfer unit 70, a cleaning unit 110 and a fixing unit 80.

Each LED unit 40 is configured to include a plurality of LEDs for exposing a corresponding photosensitive drum 53 (which will be described later).

Each process cartridge 50 is configured to include a photosensitive drum 53, which is provided to face the top face (conveyance surface) of a belt 73 (which will be described later) and is an example of a photosensitive member, and other known components such a charger, a developing roller, and a toner container shown without reference symbols. Each photosensitive drum 53 is in contact with a drum cleaner 54. The drum cleaner 54 is configured to temporarily hold toner (one example of developer) remaining on the corresponding photosensitive drum 53, and to return the toner to the photosensitive drum 53 during a cleaning operation after printing. A voltage is applied to each drum cleaner 54 by the control device 100, whereby holding of toner and returning of the toner to a corresponding photosensitive drum 53 is electrically performed.

The transfer unit 70 is provided between the sheet feeding unit 20 and the process cartridges 50. The transfer unit 70 includes a driving roller 71, a driven roller 72, the belt 73 and transfer rollers 74.

The driving roller 71 and the driven roller 72 are provided in parallel with a gap in a front-rear direction, and between them, the belt 73 composed of an endless belt is stretched. An upper surface (top surface) of an outer circumferential surface of the belt 73 is a conveyance surface for conveying the sheet P, and the conveyance surface is in contact with each photosensitive drum 53. The belt 73 is made of a material containing nylon as a main component. Further, on the inner side of the belt 73 four transfer rollers 74 (examples of transfer members) are provided to face the photosensitive drums 53, respectively, with the conveyance surface of the belt interposed therebetween. To the transfer rollers 74, transfer biases are applied by constant current control during transferring.

On the upstream side of the transfer unit 70 in a sheet conveyance direction, there is provided a sheet sensor 120 configured to detect conveyed sheet P. The sheet sensor 120 has a known photo interrupter and is configured to detect passage of a leading end and trailing end of the conveyed sheet P, and to transmit detection signal to the control device 100. On the basis of the detection signal output from the sheet sensor 120, the control device 100 is configured to perform a variety of control such as control on the timing of application of the transfer bias to each transfer roller 74.

The cleaning unit 110 is provided to face the stretched lower portion of the belt 73. The cleaning unit 110 includes a waste toner case 111, a cleaning roller 112 and a backup roller 113, which are collectively an example of a cleaning member, a second cleaning roller 114 and a blade 115.

The cleaning roller 112 is provided close to the outer circumferential surface (lower surface) of the belt 73. The backup roller 113 is provided across the belt 73 from the cleaning unit 110, such that the belt 73 is interposed between the backup roller and the cleaning roller 112.

The second cleaning roller 114 is provided on the rear side of the cleaning roller 112 to be in contact with the rear side of the cleaning roller 112. The blade 115 is configured such that a front end of the blade 115 is in contact with the second cleaning roller 114 and scrapes toner off the second cleaning roller 114.

The waste toner case 111 is provided below the second cleaning roller 114. The waste toner case 111 is configured to receive toner scraped by the second cleaning roller 114.

Between the backup roller 113 and the cleaning roller 112, a bias (voltage) for moving toner, paper dust, etc., on the belt 73 toward the cleaning roller 112, is applied. In the description of this specification, a bias which is applied to the cleaning roller 112 is referred to as a cleaning bias.

Incidentally, the control device 100 according to the exemplary embodiment is configured to control the cleaning bias by constant current control. However, the control device 100 may control the cleaning bias by constant voltage control.

Figure 2:
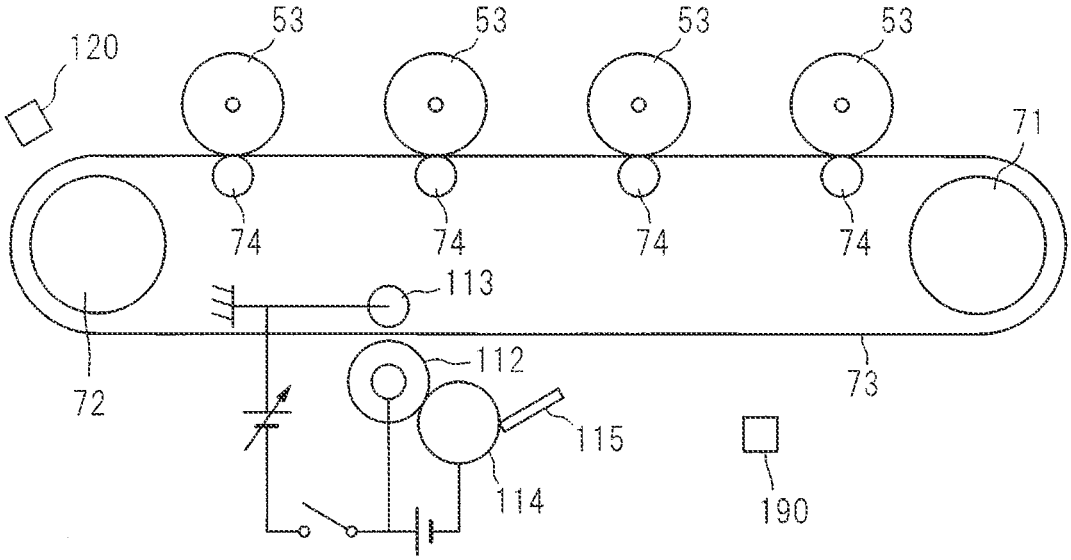
FIG. 2 is a circuit diagram for applying a cleaning bias to a cleaning member.

Specifically, as shown in FIG. 2, a negative bias (cleaning bias) with respect to the backup roller 113 grounded is applied to the cleaning roller 112, and a negative bias whose absolute value is larger than that of the bias of the cleaning roller 112 is applied to the second cleaning roller 114. Therefore, toner charged positively by the cleaning roller 112 is absorbed onto the second cleaning roller 114, and is collected in the waste toner case 111.

The fixing unit 80 includes a heating roller 81 and a pressing roller 82. The pressing roller is provided to face the heating roller 81 and is configured to press the heating roller 81.

In the image forming unit 30 configured as described above, first, the surfaces of the photosensitive drums 53 are uniformly changed by the chargers, respectively, and then are exposed by the LED units 40, respectively. As a result, the potentials of exposed portions lower, whereby electrostatic latent images based on image data are formed on the photosensitive drums 53. Subsequently, the toner is fed to the electrostatic latent images by the developing rollers, whereby toner images are carried on the photosensitive drums 53.

Next, a sheet P fed on the belt 73 passes between the photosensitive drums 53 and the transfer rollers 74, whereby the toner images formed on the photosensitive drums 53 are transferred onto the sheet P. Then, the sheet P passes between the heating roller 81 and the pressing roller 82, whereby the toner image transferred on the sheet P is thermally fixed.

The sheet discharging unit 90 includes an arc-shaped flapper 91 which is swingable back and forth and sheet discharging rollers 92. The sheet P discharged from the fixing unit 80 is guided by the inner circumferential surface of the flapper 91, is discharged to an outside of the main apparatus body 10 by the sheet discharging rollers 92, and is stacked on a sheet discharge tray 13. Incidentally, during duplex printing, a sheet P partially discharged onto the sheet discharge tray 13 by the sheet discharging rollers 92 is returned into the main apparatus body 10 and is fed again in an upside-down position along the outer circumferential surface of the flapper 91 to the upstream side of the image forming unit 30 by a plurality of reverse carriage rollers 9, due to reverse rotation of the sheet discharging rollers 92 and switching of the flapper 91.

Further, inside the main apparatus body 10, there is provided a humidity sensor 190 (see FIG. 2) as an example of a humidity determining unit for determining the humidity of the inside the main apparatus body 10. Output signals of the humidity sensor 190 are transmitted to the control device 100 to be used for a variety of control.

<Control Device>

Subsequently, the control device 100 will be described in detail. First, the flow of a cleaning process of the cleaning unit 110 will be described with reference to a flow chart of FIG. 3, and then exemplary embodiments of paper dust removal control during printing will be described with reference to FIGS. 4 and 5 illustrating the timings of application of biases to the cleaning roller 112.

In the description of exemplary embodiments of the present invention, the term "during printing" means a period in which the process cartridges 50 are operating, specifically, a period in which predetermined currents or voltages are applied to the chargers and the developing rollers in order to perform printing.

The control device 100 is configured to control a cleaning bias to be applied to the cleaning roller 112 such that toner, paper dust, and so forth attached onto the outer circumferential surface of the belt 73 is absorbed onto the cleaning roller 112.

Figure 3:
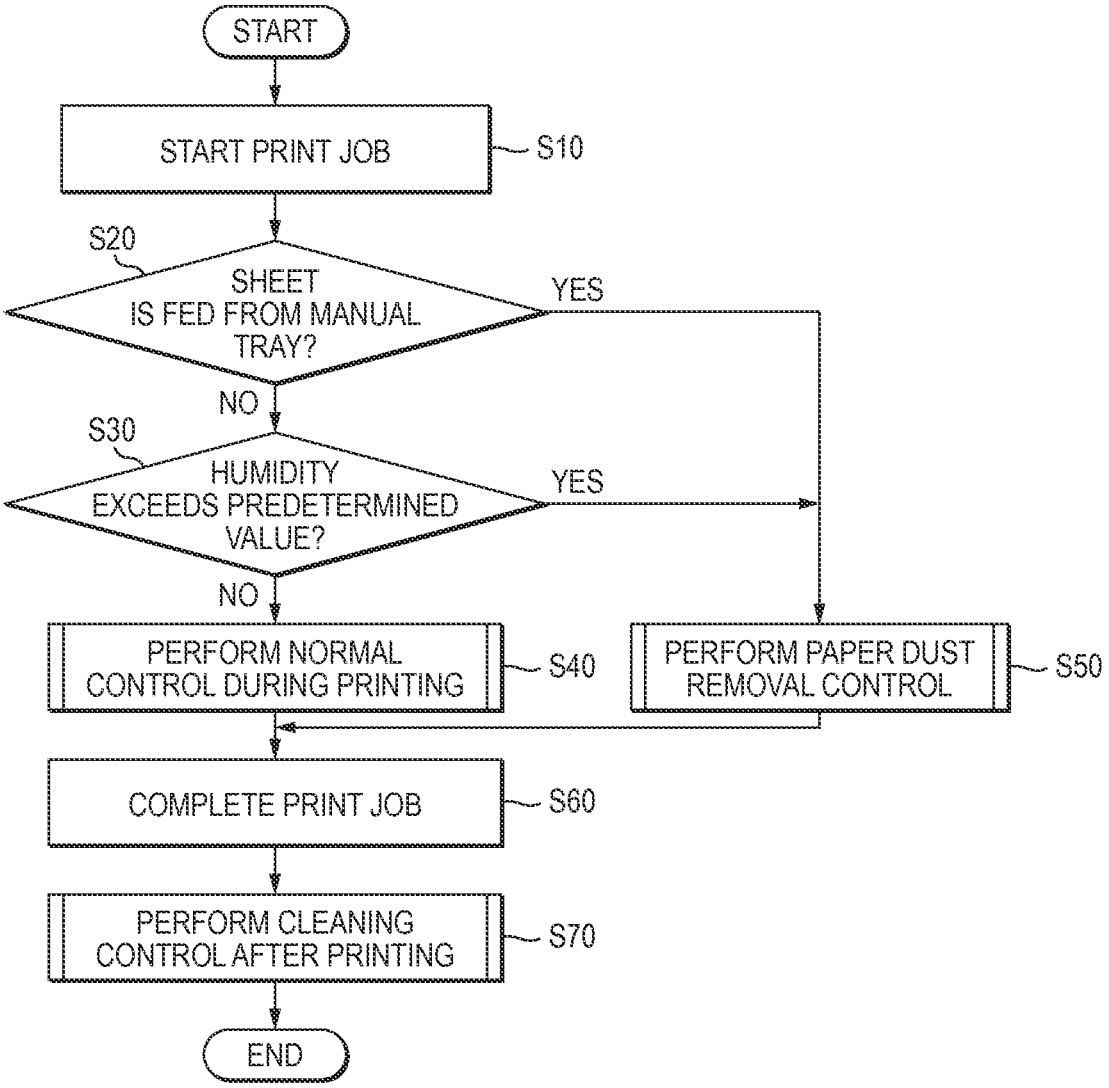
FIG. 3 is a flow chart illustrating the flow of a belt cleaning process by the cleaning member.
Figure 4:
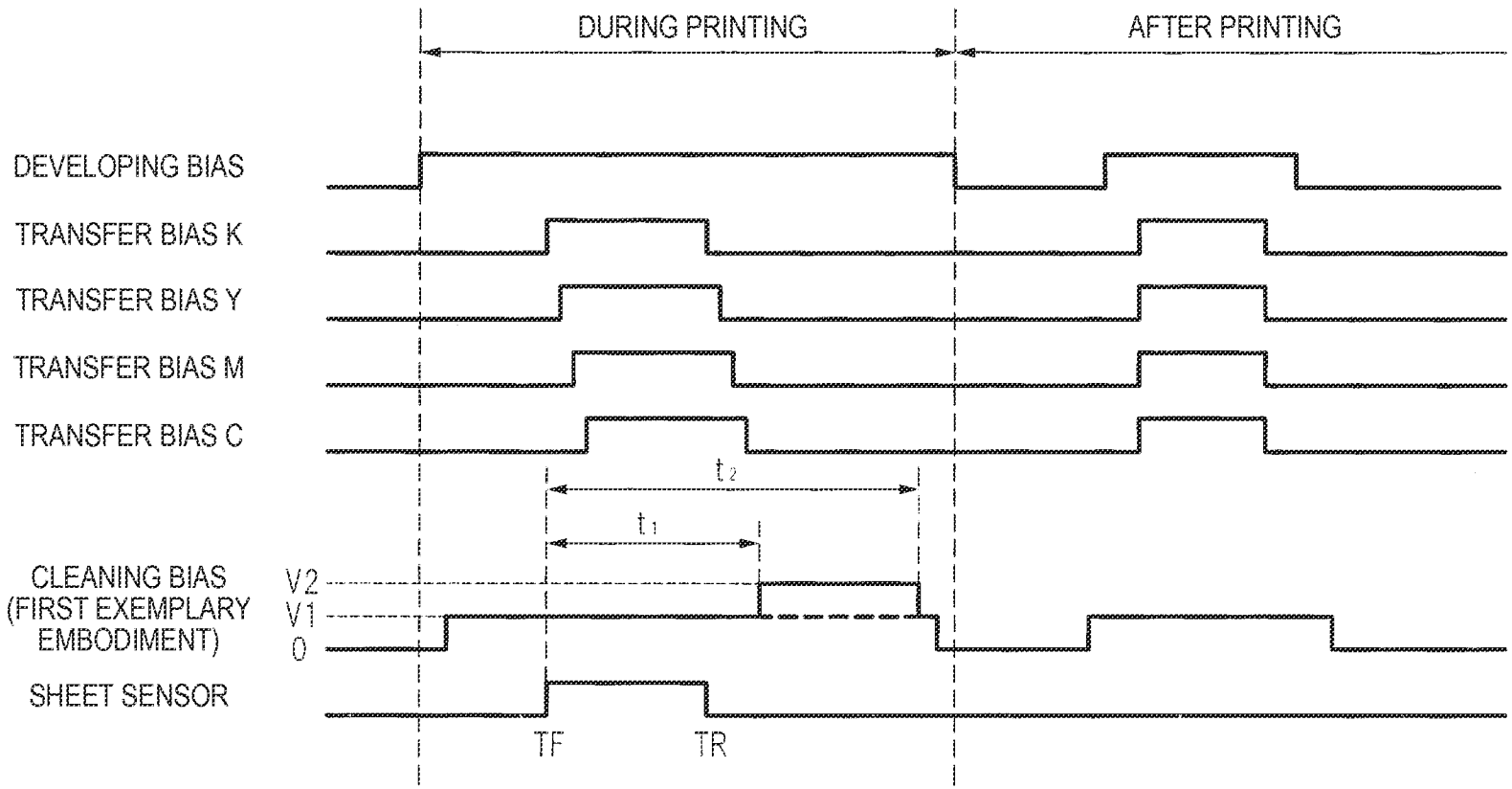
FIG. 4 is a timing chart illustrating a timing when a bias is applied to a cleaning member by a control device according to a first exemplary embodiment.

As shown in FIG. 3, when the control device 100 recognizes that a printing command signal has been received and a print job has started in STEP S10, first, in STEP S20, the control device 100 analyzes the printing command and determines whether the sheet P is fed from the manual feed tray 25. In a case where it is determined that the print job is not a job for the sheet fed from the manual feed tray 25 (No in STEP S20), in STEP S30, the control device 100 determines whether an output value of the humidity sensor 190 exceeds a predetermined value. In a case where the value of the humidity sensor 190 does not exceed the predetermined value (No in STEP S30), the control device 100 performs normal control during printing in STEP S40 until the print job completes in STEP S60.

In a case where it is determined "Yes" in STEP S20 or STEP S30, that is, in a case where the control device 100 determines that sheets P are fed from manual feed tray 25 or that the humidity exceeds the predetermined value, in STEP S50, the control device 100 starts paper dust removal control.

After the print job completes in STEP S60, in STEP S70, the control device 100 performs cleaning control after printing. In the present exemplary embodiment, the completion of the print job is determined on the basis of a detection result of the sheet sensor 120.

Subsequently, the outlines of the normal control during printing, the paper dust removal control, and the cleaning control after printing according to the exemplary embodiment of the present invention will be described with reference to FIGS. 4 and 5. FIGS. 4 and 5 illustrate a case of printing one sheet P for convenience of explanation.

In the following exemplary embodiment, in STEP S40 of performing the normal control during printing, a bias current (a first bias V1) of −10 μA is applied as the cleaning bias. Further, in STEP S50 of performing the paper dust removal control, a bias current (a second bias V2) of −50 μA whose absolute value is larger than that of the first bias V1 is applied as the cleaning bias at a predetermined timing, which has been determined on the basis of a timing when a portion of the belt 73 where a conveyed sheet P is placed passes the cleaning roller 112.

Incidentally, the values of the first bias V1 and the second bias V2 are merely illustrative, and depend on the configuration of the color printer 1, or conditions of toner to be used, or the like. As the first bias V1, an optimal magnitude for collecting and removing residual toner is selected and set, and as the second bias V2, an optimal magnitude for collecting and removing paper dust is selected and set.

With respect to specific timings of application of the cleaning biases of the control device 100 and a method of determining the specific timings, some exemplary embodiments will be described below. Incidentally, in FIGS. 4 and 5, it is assumed that a period in which printing is being performed is matched with a period of application of a developing bias to the developing rollers (FIG. 4) for the purpose of printing.

(1) First Exemplary Embodiment (Normal Control During Printing)

In a first exemplary embodiment, as shown in FIG. 4, after a printing command signal is received, when it is determined to perform the normal control during printing in STEP S40, the control device 100 first starts application of the first bias V1 to the cleaning roller 112. Then, during a normal printing operation, the control device 100 performs normal cleaning during printing so as to mainly remove toner, until the print job completes in STEP S60. On the other hand, when the leading end of a sheet P is detected by the sheet sensor 120 at a timing TF, application of transfer biases to the four transfer rollers 74 sequentially starts.

In STEP S40 of performing the normal control during printing, transfer biases K, Y, M, and C are applied to the four transfer rollers 74, respectively, sequentially from the upstream side in the conveyance direction of the sheet P, whereby transferring of the individual transfer rollers 74 is sequentially performed. During this time, as described above, the drum cleaners 54 temporarily collect toner remaining on the individual photosensitive drums 53 after the transferring and hold the toner. Further, toner attached onto the belt 73 is collected by the cleaning roller 112 to which the first bias V1 has been applied. Here, the cleaning bias is fixed at the first bias V1, and is not changed (see a broken line of FIG. 4).

(Paper Dust Removal Control)

On the other hand, when the control device 100 determines to perform the paper dust removal control in STEP S50, first, the control device 100 starts application of the first bias V1 to the cleaning roller 112, like in the case of the normal control during printing. Then, when the leading end of a sheet P is detected at the timing TF by the sheet sensor 120, the control device 100 starts to apply the transfer biases to the transfer rollers 74. Then, after a first predetermined time t1 elapses from the timing TF of the detection of the leading end of the sheet P by the sheet sensor 120, the control device 100 switches the magnitude of the cleaning bias to be applied to the cleaning roller 112, from the first bias V1 to the second bias V2 that is appropriate for removing paper dust, Then, for a second predetermined time t2 from the timing TF of the detection of the leading end of the sheet P by the sheet sensor 120, the control device 100 continues to apply the second bias V2, thereby performing the paper dust removal cleaning to remove paper dust together with toner.

Even in STEP S50 of performing the paper dust removal control, toner remaining on the individual photosensitive drums 53 after transferring is temporarily collected and held by the drum cleaners 54.

Thereafter, at a timing when the second predetermined time t2 elapses from the TF of the detection of the leading end of the sheet P by the sheet sensor 120, the control device 100 switches the magnitude of the cleaning bias to be applied to the cleaning roller 112, from the second bias V2 to the first bias V1. Then, the control device 100 continues to apply the first bias V1 until the print job completes in STEP S60.

Here, the first predetermined time t1 is a time obtained by subtracting a predetermined time ta from a time tffc from the timing TF of the detection of the leading end of the sheet P by the sheet sensor 120 to when a portion of the belt 73 where the leading end of the sheet P is placed reaches the cleaning roller 112. The reason for subtracting the predetermined time ta from the time tffc in this manner is for including "an area where a possibility that the paper dust is attached thereto is high" which is in front of the position of the belt 73 where the leading end of the sheet P is placed in a cleaning range, thereby securely removing paper dust.

Similarly, the second predetermined time t2 is a time obtained by adding a predetermined time tb to a time tfrc from the timing TF of the detection of the leading end of the sheet P by the sheet sensor 120 to when a portion of the belt 73 where the trailing end of the sheet P is placed reaches the cleaning roller 112. The for adding the predetermined time tb to the time tfrc in this manner is for including "an area where a possibility that paper dust is attached thereto is high" which is posterior to the position of the belt 73 where the trailing end of the sheet P is placed in the cleaning range, thereby securely removing paper dust.

The control device 100 uses various values such as a designated value input by the user, and a value determined by software, and information on the size of the sheet P acquired by the control device 100, particularly, the length of the sheet P in the conveyance direction to determine the "time tfrc from the timing TF of the detection of the leading end of the sheet P, to when the portion of the belt 73 where the trailing end of the sheet P is placed reaches the cleaning roller 112" which is used to compute the second predetermined time t2.

The setting of the first predetermined time t1 and the second predetermined time t2 is optimized to maximize the paper dust removal effect, without unnecessarily expanding the time of application of the large second bias V2 advancing deterioration of the cleaning roller 112 or the belt 73. Further, in view of the effects based on discharging of portions of the belt 73 where electric charge injected by applying the transfer biases is remaining or on uniformizing of the charged states of those portions, it is preferable to apply the second bias V2 to a range including portions of the belt 73 to which the transfer biases have been applied.

(Cleaning Control After Printing)

After the print job completes in STEP S60, the control device 100 performs the cleaning control after printing in STEP S70. In STEP S70 of performing the cleaning control after printing, the transfer biases are simultaneously applied to the four transfer rollers 74, whereby the toner and so forth returned from the drum cleaners 54 to the photosensitive drums 53 are simultaneously discharged onto the belt 73. Subsequently, the toner and so forth on the belt 73 is collected by the cleaning roller 112 to which a predetermined cleaning bias (the first bias V1 of −10 μA in the present exemplary embodiment) has been applied.

According to the above-described exemplary embodiment, it is possible to obtain the following advantages.

It becomes possible to sequentially remove paper dust generated during a printing operation. Accordingly, it is possible to suppress deterioration of image quality attributable to filming of the photosensitive members by paper dust.

Further, the second bias V2 larger than the first bias V1 is applied while a portion of the outer circumferential surface of the belt 73 where a sheet P is placed faces the cleaning roller 112. Accordingly, it is possible to intensively clean the portion of the belt 73 where the sheet P is placed and a possibility that paper dust is attached thereto is high, by applying the second bias V2 set to have a magnitude appropriate for collecting paper dust.

Further, the second bias V2 that is larger than the first bias V1 is not applied while a portion of the belt 73 where a sheet P is not placed (a possibility that paper dust is attached thereto is low) faces the cleaning roller 112. Accordingly, it is possible to suppress deterioration of the cleaning roller 112 or the belt 73 due to continuous application of a high bias, and to expand the service life of the cleaning roller 112 or the belt 73.

A range from a position slightly forward from a position where the leading end portion of a sheet P faces the cleaning roller 112 to a position slightly backward from the position where the trailing end portion of the sheet P faces the cleaning roller 112 is set as a range to which the second bias V2 is applied. Accordingly, it is possible to securely clean the range to which paper dust is likely to be attached.

In order to transfer toner and so forth from the belt 73, a cleaning bias whose polarity is opposite to that of the transfer biases is applied. Therefore, it is possible to remove residual electric charge of the belt 73, together with paper dust and toner. In the present exemplary embodiment, since control is performed such that the second bias V2 larger than the first bias V1 is applied to portions of the belt 73 where electric charge injected by applying the transfer biases is remaining, it becomes possible to effectively and efficiently perform discharging while suppressing application of a large bias over a long time which accelerating deterioration of the cleaning roller 112 or the belt 73. As a result, the belt 73 is discharged, the charged state (electric charge distribution) of the belt 73 is uniformized. Therefore, in a case of continuously printing a plurality of sheets P, it is possible to improve qualities of images be formed on subsequent sheet P.

Incidentally, the control device 100 performs the paper dust removal control in STEP S50 in a case where it is determined that a conveyed sheet P is a sheet fed from the manual feed tray 25 or in a case where it is determined that the value of the humidity sensor 190 for determining the humidity of the inside of the main apparatus body 10 exceeds the predetermined value (see STEPS S20 and S30 of FIG. 3).

According to this configuration, only under a condition in which paper dust is likely to be deposited and thus deterioration of image quality due to filming is especially likely to occur, control for change to the second bias V2 larger than the first bias V1 is performed, As a result, it is possible to restrict the time where the second bias V2 is applied, without substantially undermining the paper dust removal effect. Therefore, it is possible to suppress deterioration of the cleaning roller 112 or the belt 73.

(2) Second Exemplary Embodiment

Subsequently, a second exemplary embodiment of the present invention will be described mainly with reference to FIG. 5A. The present exemplary embodiment is obtained by changing a portion of the above-described method of determining the timing of application of the cleaning bias according to the first exemplary embodiment.

Figures 5A, 5B, 5C:
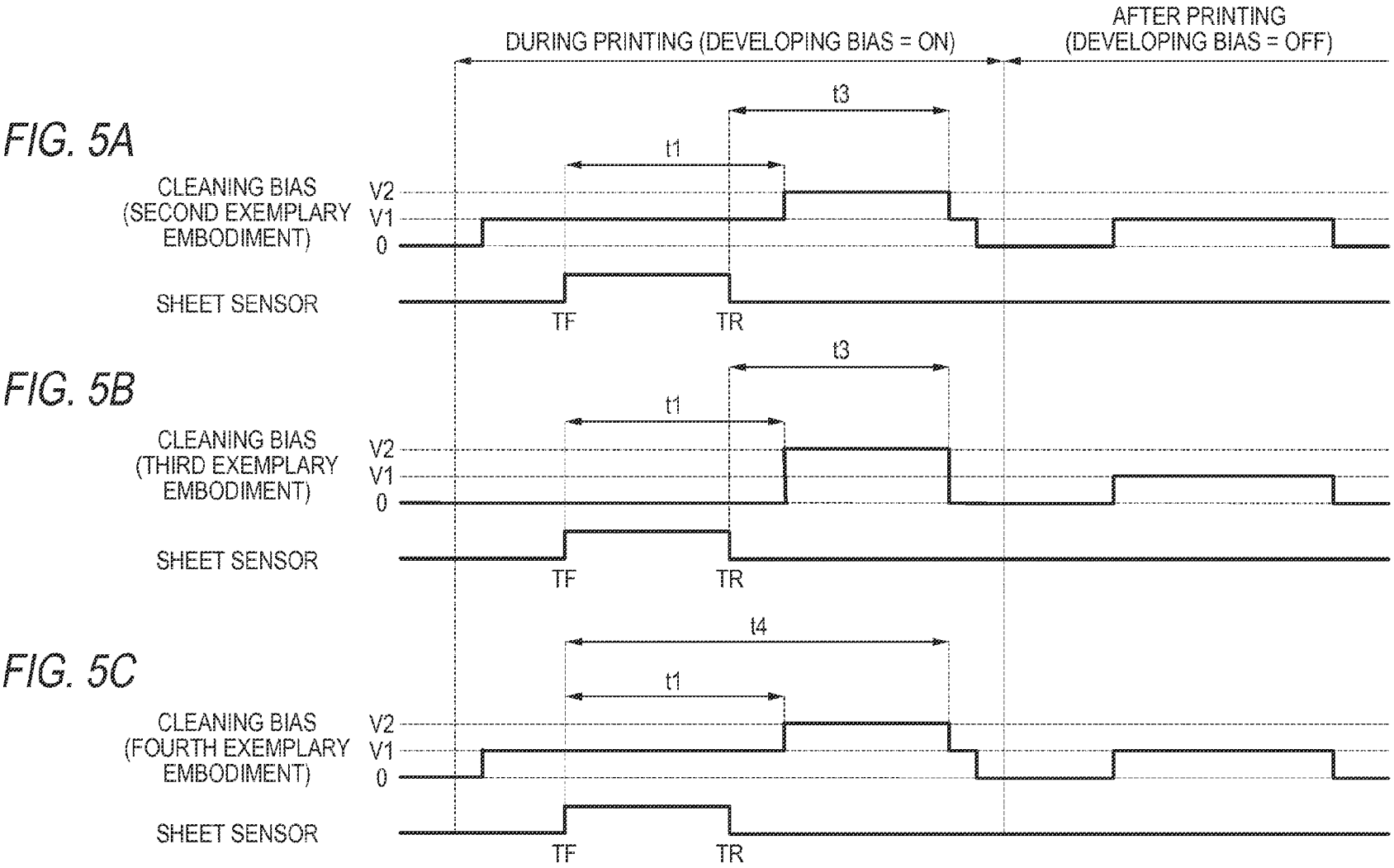
FIGS. 5A to 5C are timing charts illustrating timings when biases are applied to the cleaning member by control devices according to second to fourth exemplary embodiments.

As shown in FIG. 5A, the timing of application of the cleaning bias of the present exemplary embodiment is substantially the same as that of the first exemplary embodiment, except that, in STEP S50 of performing the paper dust removal control, a signal of a timing TR of detection of the trailing end of the sheet P by the sheet sensor 120 is used to determine a timing to return the magnitude of the cleaning bias to be applied to the cleaning roller 112, from the second bias V2 to the first bias V1.

In the present exemplary embodiment, in STEP S50 of performing the paper dust removal control, the control device 100 first starts application of the first bias V1 to the cleaning roller 112. Then, after the first predetermined time t1 elapses from the timing TF of the detection of the leading end of the sheet P by the sheet sensor 120, similarly to the first exemplary embodiment, the control device 100 switches the magnitude of the cleaning bias to be applied to the cleaning roller 112 from the first bias V1 to the second bias V2. Then, for a third predetermined time t3 from the timing TR of the detection of the trailing end of the sheet P by the sheet sensor 120, the control device 100 continues to apply the second bias V2, thereby performing the paper dust removal cleaning to remove paper dust together with toner.

Subsequently, at a timing when the third predetermined time t3 elapses from the timing TR of the detection of the trailing end of the sheet P by the sheet sensor 120, the control device 100 switches the magnitude of the cleaning bias to be applied to the cleaning roller 112 from the second bias V2 to the first bias V1. Then, the control device 100 continues to apply the first bias V1 until the print job completes in STEP S60.

Here, as the third predetermined time t3 is a time obtained by adding a predetermined time tc to a time trrc from the timing TR of the detection of the trailing end of the sheet P to when a position of the belt 73 where the trailing end of the sheet P is placed reaches the cleaning roller 112. The reason for adding the predetermined time tc to the time trrc is the same as the reason of the adjustment during the setting of the second predetermined time t2 in the first exemplary embodiment, which is, for including "an area where a possibility that paper dust is attached thereto is high" which is posterior to the position of the belt 73 where the trailing end of the sheet P is placed in the clearing range in order to securely remove paper dust.

The adjustment in setting the third predetermined time t3 is performed together with the adjustment of the first predetermined time t1, and the combination of the predetermined times t1 and t3 is optimized to maximize the paper dust removal effect, without unnecessarily expanding the time of application of the large second bias V2 advancing deterioration of the cleaning roller 112 or the belt 73.

In the present exemplary embodiment, information on the size of the sheet P is not used to determine the timing to switch the magnitude of the cleaning bias to be applied to the cleaning roller 112 from the second bias V2 to the first bias V1. Therefore, even in a case where the information acquired by the control device 100 is wrong, appropriate timing control based on correct information on the position of the trailing end of the sheet P is possible.

(3) Third Exemplary Embodiment

Subsequently, a third exemplary embodiment of the present invention will be described mainly with reference to FIG. 5B. A feature of the present exemplary embodiment is that the value of the cleaning bias during printing (during application of the developing bias) is not V1 (−10 μA) but 0 μA, unlikely the first exemplary embodiment or the second exemplary embodiment.

In other words, after receiving a printing command signal and determining to perform the normal control during printing in STEP S40 or the paper dust removal control in STEP S50, the control device 100 does not start to apply the first bias V1. That is, the control device 100 does not substantially perform the normal control during printing in STEP S40, and does not apply the cleaning bias in STEP S50 of performing the paper dust removal control until the timing of application of the second bias V2.

In the present exemplary embodiment, it is possible to perform effective paper dust removal cleaning by applying the second bias, similarly to the first exemplary embodiment and the second exemplary embodiment. Further, in the present exemplary embodiment, the cleaning bias is not applied while a portion of the belt 73 where the sheet P is not placed and a possibility that paper dust is attached thereto is comparatively low faces the cleaning roller 112. Therefore, it is possible to expand the service life of the cleaning roller 112 or the belt 73.

(4) Fourth Exemplary Embodiment

Subsequently, a fourth exemplary embodiment of the present invention will be described mainly with reference to FIG. 5C. The present exemplary embodiment is different from the first to third exemplary embodiments in the timing of application of the cleaning bias, specifically, a completion timing of application of the second bias V2.

As shown in FIG. 4 and FIGS. 5A and 5B, in the first exemplary embodiment to the third exemplary embodiment, the completion timing of application of the second bias V2 is set to be slightly later than the timing when the position of the belt 73 where the trailing end of the sheet P is placed reaches the cleaning roller 112. In the present exemplary embodiment, as shown in FIG. 5C, at a timing when a fourth predetermined time t4 elapses from the timing TF of the detection of the leading end of the sheet P by the sheet sensor 120, the control device 100 switches the magnitude of the cleaning bias to be applied to the cleaning roller 112 from the second bias V2 to the first bias V1.

Specifically, the fourth predetermined time t4 is obtained by adding a time tdr, which is necessary for the belt 73 to run by the length of the outer circumference of a photosensitive drum 53, to a time tfrc from the timing TF of the detection of the leading end of the sheet P to when the position of the belt 73 where the trailing end of the sheet P is placed reaches the cleaning roller 112. That is, the fourth exemplary embodiments corresponds to a case where the predetermined time tb in the first exemplary embodiment is set to the time tdr.

That is, the control device 100 performs control such that the second bias V2 is applied while the portion of the outer circumferential surface of the belt 73 from a position where the trailing end of the sheet P is placed to a position posterior to the position of the rear end by the length of the outer circumference of the photosensitive drum 53 faces the cleaning roller 117.

According to this configuration, in addition to the above-described advantages according to the first exemplary embodiment to the third exemplary embodiment, there is a great advantage in terms of the belt discharging effect. That is, it is possible to effectively discharge portions of the belt 73 where electric charge injected by applying the transfer biases is remaining or to uniformize the charged states (electric charge distributions) of the corresponding portions by second bias V2 larger than the first bias V1. According thereto, it is possible to improve the quality of an image to be formed on subsequent sheet P.

Incidentally, in the fourth exemplary embodiment shown in FIG. 5C, the completion timing of the application of the second bias V2 is determined by computing an elapse time from the timing TF of the detection of the leading end of the sheet P by the sheet sensor 120, like in the first exemplary embodiment; however, it can be determined by use of the timing TR of the detection of the rear end of the sheet P by the sheet sensor 120, like in the second exemplary embodiment.

EXAMPLES

Figure 6:
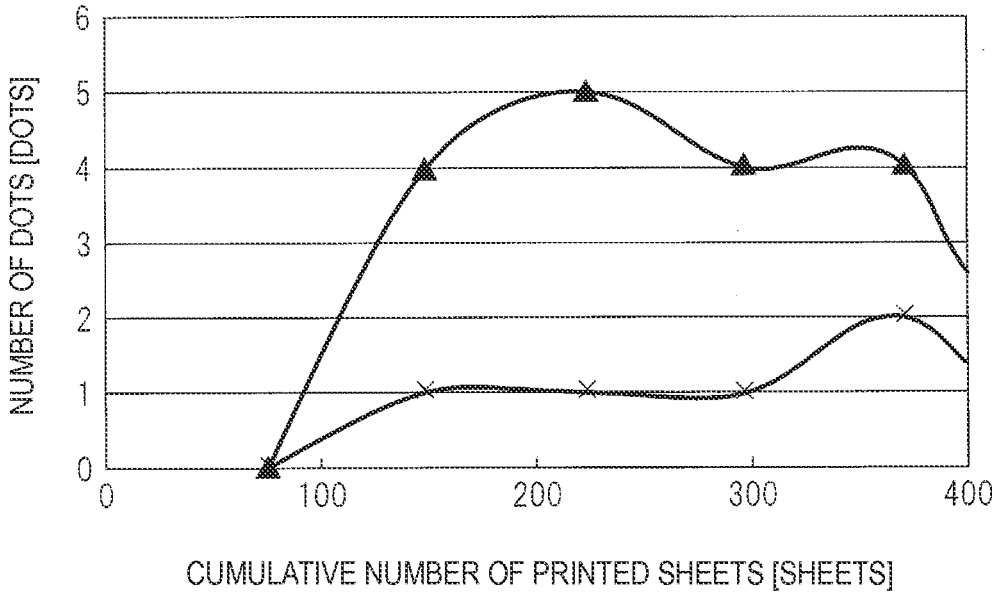
FIG. 6 is a graph illustrating the effects of application of a cleaning bias to an endless belt on image quality.

The results of experiments in which the effect of performance of the paper dust removal control on image quality has been confirmed are shown in FIG. 6. Printing was repeated under the same condition. As the number of printed sheets was cumulated, stains which appeared in printed images were recorded in the number of dots, with respect to a case where only the normal control during printing was performed and a case where only the paper dust removal control was performed. The printing results in the case where only the normal control during printing was performed, that is, in a case where printing was performed in a state where the cleaning bias was fixed at the first bias V1 (−10 μA) are represented by a symbol "▲", and the printing results in the case where only the paper dust removal control was performed, that is, in a case where control was performed such that the cleaning bias was changed from the first bias V1 to the second bias (−50 μA) according to the above-described first exemplary embodiment are represented by a symbol "x".

As graphically shown in FIG. 6, it was observed that in the case the paper dust removal control of the present exemplary embodiment was performed during printing, image qualities was remarkably improved as compared to the case where only the normal control during printing was performed.

Although the exemplary embodiments of the present invention have been described above, the present invention is not limited to the above-mentioned exemplary embodiments. The specific configurations can be appropriately modified within the scope of the present invention.

In the above-described exemplary embodiments, for convenience of illustration, an example in which one sheet is printed and output by one print job. However, naturally, a printing command signal for performing continuous printing of continuously printing a plurality of sheets P can be transmitted to the control device 100. In this case, it is preferable to continuously apply the second bias V2 from when a portion of the outer circumferential surface of the belt 73 where the leading end of the first sheet P is placed reaches the cleaning roller 112 to when a portion of the outer circumferential surface of the belt 73 where the rear end of the last sheet P is placed reaches the cleaning roller 112.

The reason is that when the continuous printing is performed, by applying the second bias without interruptions at portions of the outer circumferential surface of the belt 73 where the end portions of each sheet, which are especially likely to generate paper dust, are placed, it is possible to more effectively remove the paper dust. Further, by control simpler than the fourth exemplary embodiment, it becomes possible to effectively discharge portions of the belt 73 where electric charge injected by applying the transfer biases is remaining (or uniformize the charged states of the corresponding portions).

In the above-described exemplary embodiments, the present invention has been applied to the color printer 1. However, the present invention is not limited thereto. The present invention can also be applied to other image forming apparatuses, for example, copy machines, multi-function devices, etc.

In the above-described exemplary embodiments, as examples of recording sheets, sheets P such as cardboard (thick paper), postcard, and thin paper have been exemplified. However, recording sheets usable for image forming apparatuses to which the present invention can be applied are not limited thereto. For example, other sheets, for example, OHP sheets can be used.

In the above-described exemplary embodiments, as photosensitive members, the photosensitive drums 53 have been exemplified. However, the present invention is not limited thereto. For example, belt-like photosensitive members may be used.

In the above-described exemplary embodiments, as transfer members, the transfer rollers 74 have been used. However, image forming apparatuses to which the present invention can be applied are not limited to apparatuses having those transfer members. For example, transfer members having shapes other than the roller shape can be used.

In the above-described exemplary embodiments, as the cleaning member, the cleaning roller 112 and the backup roller 113 have been used. However, the present invention is not limited thereto. Any other members having shapes other than the roller shape may be used.

What is claimed is:

1. An image forming apparatus comprising:

an endless belt having an outer circumferential surface for conveying a recording sheet;

a photosensitive member that is provided to face the outer circumferential surface of the endless belt;

a sensor configured to detect a leading end of the conveyed recording sheet;

a cleaning member that is provided to face the outer circumferential surface of the endless belt and that is configured to clean the outer circumferential surface of the endless belt; and a control device configured to control a cleaning bias to be applied to the cleaning member, wherein the control device is configured to control the cleaning bias so as to:

apply a first bias to the cleaning member before a portion of the outer circumferential surface of the endless belt, which has contacted the recording sheet since being cleaned by the cleaning member, faces the cleaning member; and apply a second bias, which is larger than the first bias, to the cleaning member while the portion of the outer circumferential surface of the endless belt, which has contacted the recording sheet since being cleaned by the cleaning member, faces the cleaning member, and wherein the control device is configured to change the cleaning bias from the first bias to the second bias when a first predetermined time elapses from a timing of detection of the leading end of the recording sheet by the sensor.

2. The image forming apparatus according to claim 1, wherein when a second predetermined time, which is longer than the first predetermined time, elapses from the timing of the detection of the leading end of the recording sheet by the sensor, the control device changes the cleaning bias from the second bias to the first bias.

3. The image forming apparatus according to claim 1, wherein, when a third predetermined time elapses from a timing of detection of a rear end of the recording sheet by the sensor, the control device changes the cleaning bias from the second bias to the first bias.

4. The image forming apparatus according to claim 1, wherein the control device is configured to control the cleaning bias so as to apply the second bias to the cleaning member while a portion of the outer circumferential surface of the endless belt, which is from a position where the rear end of the recording sheet is placed to a position posterior to the position where the rear end of the recording sheet is placed by a length of the outer circumference of the photosensitive member, faces the cleaning member.

5. The image forming apparatus according to claim 2, wherein the second predetermined time is determined according to a length of the recording sheet in a conveyance direction.

6. The image forming apparatus according to claim 2, wherein the second predetermined time is determined according to a sum of a length of the recording sheet in a conveyance direction and a length of the outer circumference of the photosensitive member.

7. The image forming apparatus according to claim 1, further comprising:

a humidity determining unit configured to determine an internal humidity of a main apparatus body of the image forming apparatus, wherein,. when the humidity determining unit determines that the internal humidity exceeds predetermined humidity, the control device changes the cleaning bias from the first bias to the second bias.

8. The image forming apparatus according to claim 1, further comprising:

a manual feed tray that is swingably supported by a main apparatus body of the image forming apparatus and that is configured to feed the recording sheet, wherein, when a conveyed recording sheet is fed from the manual feed tray, the control device changes the cleaning bias from the first bias to the second bias.

9. An image forming apparatus comprising:

an endless belt having an outer circumferential surface for conveying a recording sheet;

a photosensitive member that is provided to face the outer circumferential surface of the endless belt;

a cleaning member that is provided to face the outer circumferential surface of the endless belt and that is configured to clean the outer circumferential surface of the endless belt; and a control device configured to control a cleaning bias to be applied to the cleaning member, wherein the control device is configured to control the cleaning bias so as to:

apply a first bias to the cleaning member before a portion of the outer circumferential surface of the endless belt, which has contacted the recording sheet since being cleaned by the cleaning member, faces the cleaning member; and apply a second bias, which is larger than the first bias, to the cleaning member while the portion of the outer circumferential surface of the endless belt, which has contacted the recording sheet since being cleaned by the cleaning member, faces the cleaning member, and wherein, when continuous printing is performed to continuously print a plurality of recording sheets, the control device is configured to control the cleaning bias so as to continuously apply the second bias to the cleaning member from when a portion of the outer circumferential surface of the endless belt where the leading end of a first recording sheet is positioned reaches the cleaning member to when a portion of the outer circumferential surface of the endless belt where the rear end of a last recording sheet is positioned reaches the cleaning member.

10. An image forming apparatus comprising:

an endless belt configured to convey a recording sheet;

an image forming unit configured to form an image on the recording sheet conveyed by the endless belt;

a cleaning member configured to clean the endless belt;

a sensor configured to detect the recording sheet;

a control device configured to control a cleaning bias to be applied to the cleaning member, wherein the control device is configured to control the cleaning bias so as to:

apply a first bias as the cleaning bias to the cleaning member; and change the cleaning bias from the first bias to a second bias, which is larger than the first bias, when a first predetermined time elapses after the sensor detects a leading end of the recording sheet.

11. The image forming apparatus according to claim 10, wherein, when a second predetermined time, which is longer than the first predetermined time, elapses after the sensor detects the leading end of the recording sheet, the control device changes the cleaning bias from the second bias to the first bias.

12. The image forming apparatus according to claim 10, wherein the sensor is further configured to detect a trailing end of the recording sheet, and wherein, when a third predetermined time elapses after the sensor detects the trailing end of the recording sheet, the control device changes the cleaning bias from the second bias to the first bias.

13. The image forming apparatus according to claim 11, wherein the second predetermined time is determined according to a length of the recording sheet in a conveyance direction.

14. The image forming apparatus according to claim 11, wherein the image forming unit comprises a photosensitive member, and wherein the second predetermined time is determined according to a sum of a length of the recording sheet in a conveyance direction and a length of an outer circumference of the photosensitive member.

15. The image forming apparatus according to claim 10, further comprising:

a humidity determining unit configured to determine humidity inside the image forming apparatus, wherein, in a case where the humidity determining unit determines that the humidity inside the image forming apparatus exceeds a predetermined humidity, the control device changes the cleaning bias from the first bias to the second bias when the first predetermined time elapses after the sensor detects the leading end of the recording sheet, and wherein, in a case where the humidity determining unit determines that the humidity inside the image forming apparatus does not exceed the predetermined humidity, the control device keeps the cleaning bias at the first bias.

16. The image forming apparatus according to claim 10, further comprising:

a sheet cassette configured to accommodate a plurality of recording sheets;

a manual feed tray configured to accommodate a recording sheet; and a feeding unit configured to feed the recording sheet to the endless belt from the sheet cassette or the manual feed tray, wherein, in a case where the recording sheet is fed from the sheet cassette to the endless belt, the control device keeps the cleaning bias at the first bias, and wherein, in a case where the recording sheet is fed from the manual feed tray to the endless belt, the control device changes the cleaning bias from the first bias to the second bias when the first predetermined time elapses after the sensor detects the leading end of the recording sheet.

17. The image forming apparatus according to claim 9, further comprising:

a sensor configured to detect a leading end of the conveyed recording sheet, wherein, when a first predetermined time elapses from a timing of detection of the leading end of the recording sheet by the sensor, the control device changes the cleaning bias from the first bias to the second bias.

18. The image forming apparatus according to claim 17, wherein, when a third predetermined time elapses from a timing of detection of a rear end of the recording sheet by the sensor, the control device changes the cleaning bias from the second bias to the first bias.

19. The image forming apparatus according to claim 9, further comprising:

a humidity determining unit configured to determine an internal humidity of a main apparatus body of the image forming apparatus, wherein, when the humidity determining unit determines that the internal humidity exceeds a predetermined humidity, the control device changes the cleaning bias from the first bias to the second bias.

20. The image forming apparatus according to claim 9, further comprising:

a manual feed tray that is swingably supported by a main apparatus body of the image forming apparatus and that is configured to feed the recording sheet, wherein, when a conveyed recording sheet is fed from the manual feed tray, the control device changes the cleaning bias from the first bias to the second bias.

* * * * *